US011626090B1

(12) United States Patent
Wish

(10) Patent No.: US 11,626,090 B1
(45) Date of Patent: Apr. 11, 2023

(54) APPARATUS FOR PLAYING CHORDS ON MUSICAL INSTRUMENTS AND METHOD OF PERFORMING SAME

(71) Applicant: David Wish, Montclair, NJ (US)

(72) Inventor: David Wish, Montclair, NJ (US)

( * ) Notice: Subject to any disclaimer, the term of this patent is extended or adjusted under 35 U.S.C. 154(b) by 0 days.

(21) Appl. No.: 17/541,696

(22) Filed: Dec. 3, 2021

(51) Int. Cl.
*G10D 3/00* (2020.01)
*G10C 3/00* (2019.01)

(52) U.S. Cl.
CPC ..... *G10C 3/00* (2013.01)

(58) Field of Classification Search
CPC ..... G10C 3/00
See application file for complete search history.

(56) References Cited

U.S. PATENT DOCUMENTS 3,422,210 A * 1/1969 Michihiro ..... G10H 1/38 84/715

* cited by examiner

*Primary Examiner* — Kimberly R Lockett
(74) *Attorney, Agent, or Firm* — Manatt, Phelps & Phillips LLP

(57) ABSTRACT

An adaptive equipment for playing chords on a musical instrument is provided. The apparatus can have a shell having an interior cavity. The adaptive equipment has a root pin partially installed within a root housing channel of a root housing, the root housing is fixedly installed within an interior cavity of the shell and is positioned toward the left side of the shell. The adaptive equipment has a fifth pin partially installed within a fifth housing channel of a fifth housing, the fifth housing is fixedly installed within the interior cavity of the shell and is positioned toward the right side of the shell. The adaptive equipment has a third pin partially installed within a third housing channel of a third housing, the third housing is movably installed within the interior cavity of the shell and is positioned between the root housing and the fifth housing. The root pin, the third pin and the fifth pin correspond to a major triad on a piano keyboard when the third housing is positioned closer to the fifth housing. The root pin, the third pin and the fifth pin correspond to a minor triad on the piano keyboard when the third housing is positioned closer to the root housing.

20 Claims, 12 Drawing Sheets

APPARATUS FOR PLAYING CHORDS ON MUSICAL INSTRUMENTS AND METHOD OF PERFORMING SAME

CROSS-REFERENCE TO RELATED APPLICATIONS

None.

BACKGROUND

Technical Field

This disclosure relates generally to apparatus for playing chords on musical instruments and more specifically relates to an apparatus and method for playing chords on piano keyboard.

Related Art

In music, a note is a symbol denoting a musical sound. A note can also be the sound itself in English usage, for example, pitch classes are typically represented by the first seven letters of the Latin alphabet (A, B, C, D, E, F and G). The eighth note, or octave, is given the same name as the first, but has double its frequency.

A chord is typically referred to any harmonic set of pitches or frequencies consisting of multiple notes that are heard as if sounding simultaneously. In music with a tonic key or home key, such as the tonal western classical music, the most frequently encountered chords are triads. A triad chord is formed with three distinct notes: a root note, a third note (the note or pitch two scale degrees above the root note), and a fifth note (the note or pitch four scale degrees above the root note). A chord can have more than three notes to form added tone chord, extended chord and tone cluster, etc. A chord progression is a series of chords that melody and rhythm are built.

A major chord is a chord that has a root, a major third and a perfect fifth. When a chord has these three notes alone, it is called a major triad. For example, a C major triad (a major triad built on C) contains the notes C-E-G. A minor chord is a chord that has a root, a minor third and a perfect fifth. When a chord has these three notes alone, it is called a minor triad. For example, a C minor triad (a minor triad built on C) contains the notes C-E♭-G.

Most modern pianos have a row of 88 black and white keys, 52 white keys for the notes of the C major scale (C, D, E, F, G, A and B) and 36 shorter black keys, which are raised above the white keys, and set further back on the keyboard. This means that the piano can play 88 different notes, spanning a range of a bit over seven octaves.

The inventor here has found that it is not always easy, especially for neurotypical beginners, to find chords on a piano keyboard and see how the chords are made. For people without physical differences or special needs learners, the inventor here has also found that a piece of adaptive equipment can allow a person to play chords on piano.

One prior adaptive equipment is an "Octave Device" for playing octave on a piano. (See https://sites.google.com/site/instrumentadaptations/piano.) However, the Octave Device is not adapted for playing chords.

Another prior adaptive equipment is invented by a pianist who lost his fingers. The adaptive equipment has a metal tube with prongs on it. The pianist simply holds the metal tube in hands whilst the prongs hit the correct keys. (See https://www.britishpathe.com/video/fingerless-pianist/query/quirky.) However, the prongs on the metal tube appear to be located on fixed positions and the metal tube does not appear to be adapted for playing chords.

Yet another prior adaptive equipment is invented by a blind piano technician who designed and made tools for the blinds. (See https://www.indiegogo.com/projects/john-furniss-piano-service-adaptive-tools-for-the-blind#/.) However, the tool does not appear to be adapted for playing chords.

In addition, all of the existing adaptive equipment have rigid parts that are in contact with the piano. As a result, a user of any of the existing adaptive equipment does not "feel" the soft touching and resistance from the piano like real human fingers do.

Accordingly, it is here recognized that a continued need exists to overcome and improve upon such shortcomings in existing adaptive equipment. In order to address the above-described exemplary problems, and other similar problems, what is needed is an adaptive equipment for playing chords on piano or keyboard, thereby providing enhanced learning and playing experiences to the user.

SUMMARY

The present disclosure provides a family or series of adaptive equipment for playing chords on piano or keyboard.

In some embodiments, the adaptive equipment comprises a shell defined by a front side, a rear side, a left side, a right side, a top side and a bottom side, the shell having an interior cavity, a root pressing element partially installed within a root housing channel of a root housing, the root housing is fixedly installed within the interior cavity of the shell and is positioned toward the left side of the shell, a fifth pressing element partially installed within a fifth housing channel of a fifth housing, the fifth housing is fixedly installed within the interior cavity of the shell and is positioned toward the right side of the shell, and a third pressing element partially installed within a third housing channel of a third housing, the third housing is movably installed within the interior cavity of the shell and is positioned between the root housing and the fifth housing, wherein the root pressing element, the third pressing element and the fifth pressing element correspond to a major triad on a piano keyboard when the third housing is positioned toward the fifth housing, and wherein the root pressing element, the third pressing element and the fifth pressing element correspond to a minor triad on the piano keyboard when the third housing is positioned toward the root housing. In some embodiments, the front side, rear side and top side of the shell form an uniform n-shaped piece when viewing from the left side or the right side of the shell. In some embodiments, the adaptive equipment has a switch attached to the third housing. In some embodiments, the adaptive equipment has a slot opened on the shell and configured to allow a portion of the switch to slide within the slot when an extension of the switch is maneuvered by a user to switch the third housing between the root housing and the fifth housing. In some embodiments, the slot is opened on the rear side of the shell. In some embodiments, the adaptive equipment has a switching spring with one end of the switching spring attached to a right side of the root housing and another end of the switching spring attached to a left side of the third housing. In some embodiments, the adaptive equipment has a stabilized mechanism with one end of the stabilized mechanism fixedly or slidably attached to the right side of the third housing and another end of the stabilized mechanism fixedly or slidably attached to the left side of the fifth housing. In some embodiments, the adaptive equipment has the root housing channel has an upper channel having an upper channel diameter and a lower channel in connection with upper channel, and the lower channel has a lower channel diameter that is smaller than upper channel diameter. In some embodiments, the adaptive equipment has the root pressing element further comprises a root pin having a head, a body and a leg, and wherein the head is slidable within the upper channel while a portion of the body is slidable within the lower channel. In some embodiments, the adaptive equipment has the root pressing element further comprises a root cap sized to grasp the leg and having an upper ring and a lower tip, wherein the upper ring has an upper ring diameter that is larger than a diameter of the body. In some embodiments, the adaptive equipment has the root pressing element further comprises a root spring having an upper end and a lower end, wherein the root spring circle around a portion of the body of the root pin with the upper end and the lower end of the spring bias on the bottom side of the root housing and the upper ring of the cap, respectively.

In some embodiments, the adaptive equipment comprises a shell, a root pressing element, at least a portion of the root pressing element is slidably coupled within the shell and is positioned toward a first side of the shell, a fifth pressing element, at least a portion of the fifth pressing element is slidably coupled within the shell and is positioned toward a second side opposing to the first side of the shell, and a third pressing element, at least a portion of the third pressing element is slidably and movably coupled within the shell and is positioned between the root pressing element and the fifth pressing element, wherein the root pressing element, the third pressing element and the fifth pressing element correspond to a major triad on a piano keyboard when the third pressing element is positioned toward the fifth pressing element, and the root pressing element, the third pressing element and the fifth pressing element correspond to a minor triad on the piano keyboard when the third pressing element is positioned toward the root pressing element. In some embodiments, the adaptive equipment has a switch coupled to the third pressing element. In some embodiments, the adaptive equipment has a slot opened on the shell and configured to allow a portion of the switch to slide within the slot when an extension of the switch is maneuvered by a user to move the third pressing element between the root pressing element and the fifth pressing element. In some embodiments, the slot is opened on a rear side of the shell.

In some embodiments, the adaptive equipment comprises a shell having a root channel, a fifth channel and a third channel, the root channel has an upper root channel and a lower root channel in connection with upper root channel, the upper root channel has an upper root channel diameter and the lower root channel has a lower root channel diameter that is smaller than upper root channel diameter, the fifth channel has an upper fifth channel and a lower fifth channel in connection with upper fifth channel, the upper fifth channel has an upper fifth channel diameter and the lower fifth channel has a lower fifth channel diameter that is smaller than upper fifth channel diameter, the third channel has an upper third channel and a lower third channel in connection with upper third channel, the upper third channel has an upper third channel diameter and the lower third channel has a lower third channel diameter that is smaller than upper third channel diameter, a root pin slidably attached to the shell and is positioned toward a first side of the shell, the root pin has a root head, a root body and a root leg, the root head is slidable within the upper root channel while a portion of the root body is slidable within the lower root channel, a fifth pin slidably attached to the shell and is positioned toward a second side of the shell, the fifth pin has a fifth head, a fifth body and a fifth leg, the fifth head is slidable within the upper fifth channel while a portion of the fifth body is slidable within the lower fifth channel, and a third pin slidably attached to the shell and is positioned between the root pin and the fifth pin, the third pin has a third head, a third body and a third leg, the third head is slidable within the upper third channel while a portion of the third body is slidable within the lower third channel, wherein the root pin, the third pin and the fifth pin correspond to a major triad on a piano keyboard. In some embodiments, the adaptive equipment has a root cap sized to grasp the leg and having an upper ring and a lower tip, wherein the upper ring has an upper ring diameter that is larger than a diameter of the body. In some embodiments, the adaptive equipment has a root spring having an upper end and a lower end, wherein the root spring circle around a portion of the body of the root pin with the upper end and the lower end of the spring bias on a bottom side of the shell and the upper ring of the cap, respectively. In some embodiments, the adaptive equipment has a switch coupled to the third pin. In some embodiments, the adaptive equipment has a slot opened on the shell and configured to allow a portion of the switch to slide within the slot when an extension of the switch is maneuvered by a user to move the third pin between the root pin and the fifth pin.

DESCRIPTION OF EXEMPLARY EMBODIMENTS

Figure 1:
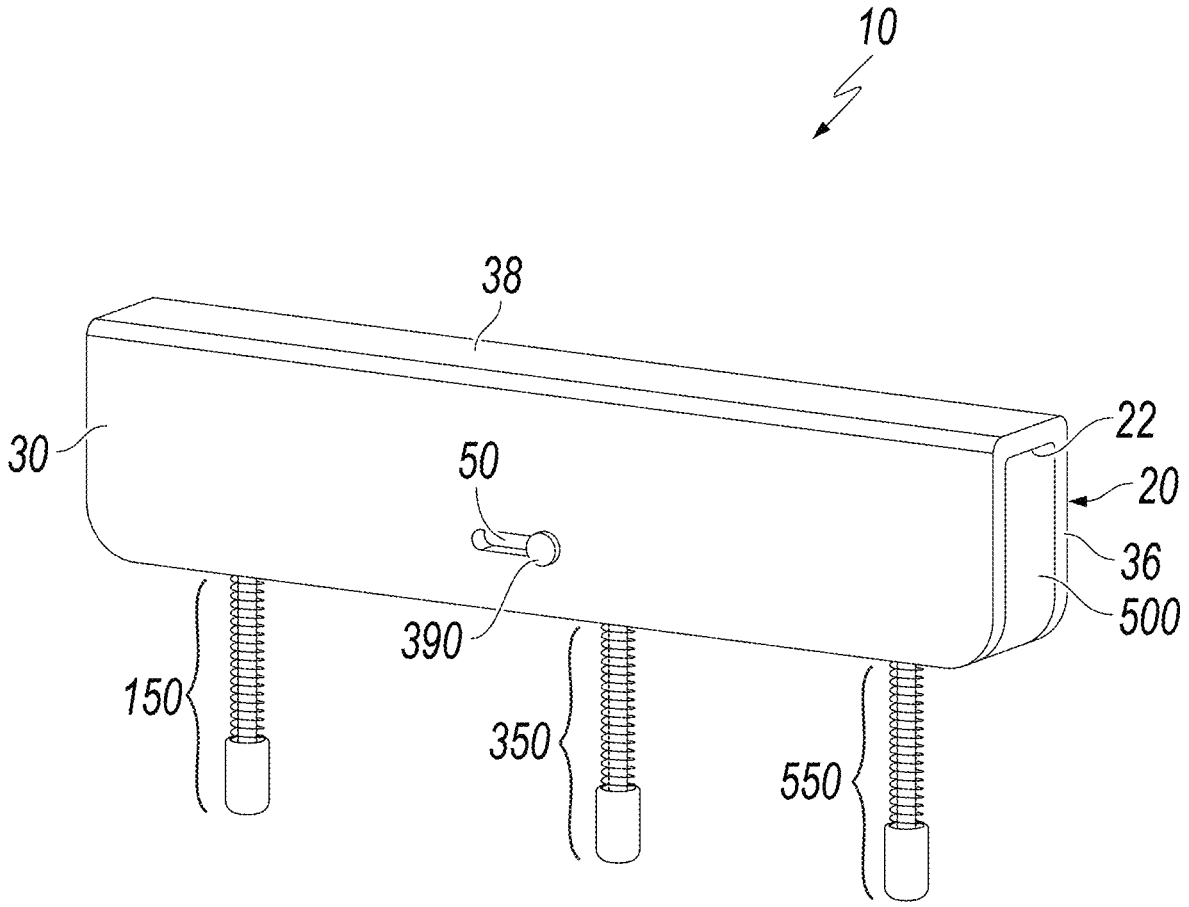
FIG. 1 illustrates a top-front-right perspective view of an exemplary PressPlay.
Figure 2:
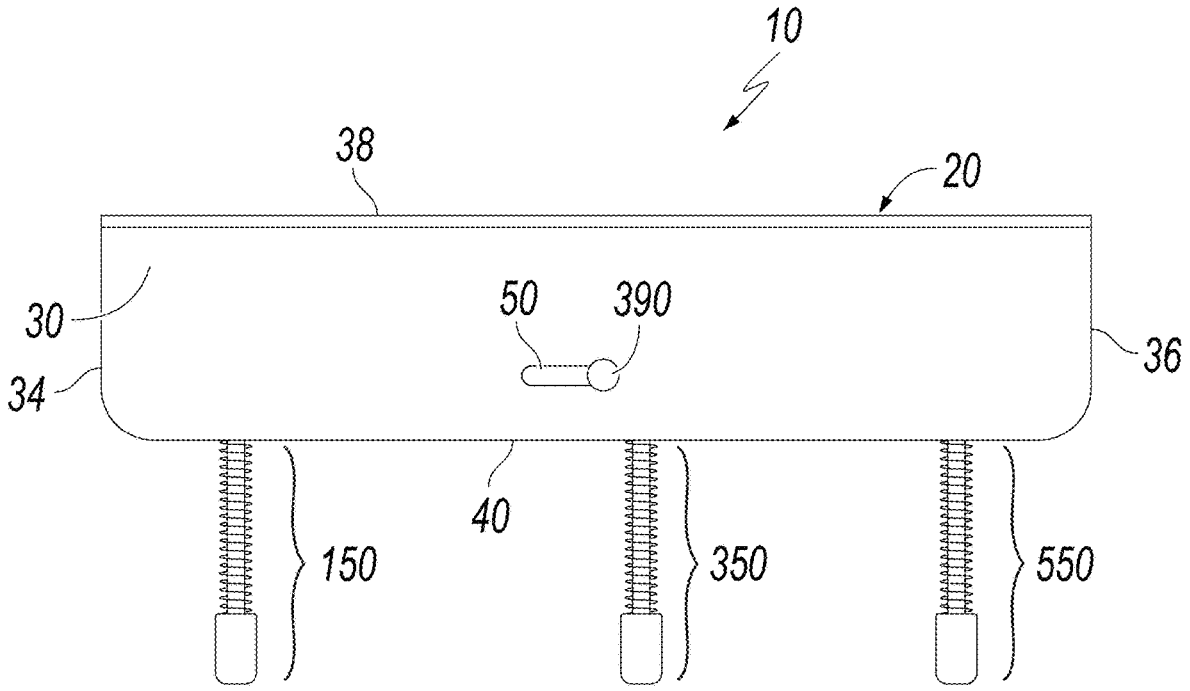
FIG. 2 illustrates a front view of the exemplary PressPlay of FIG. 1.
Figure 3:
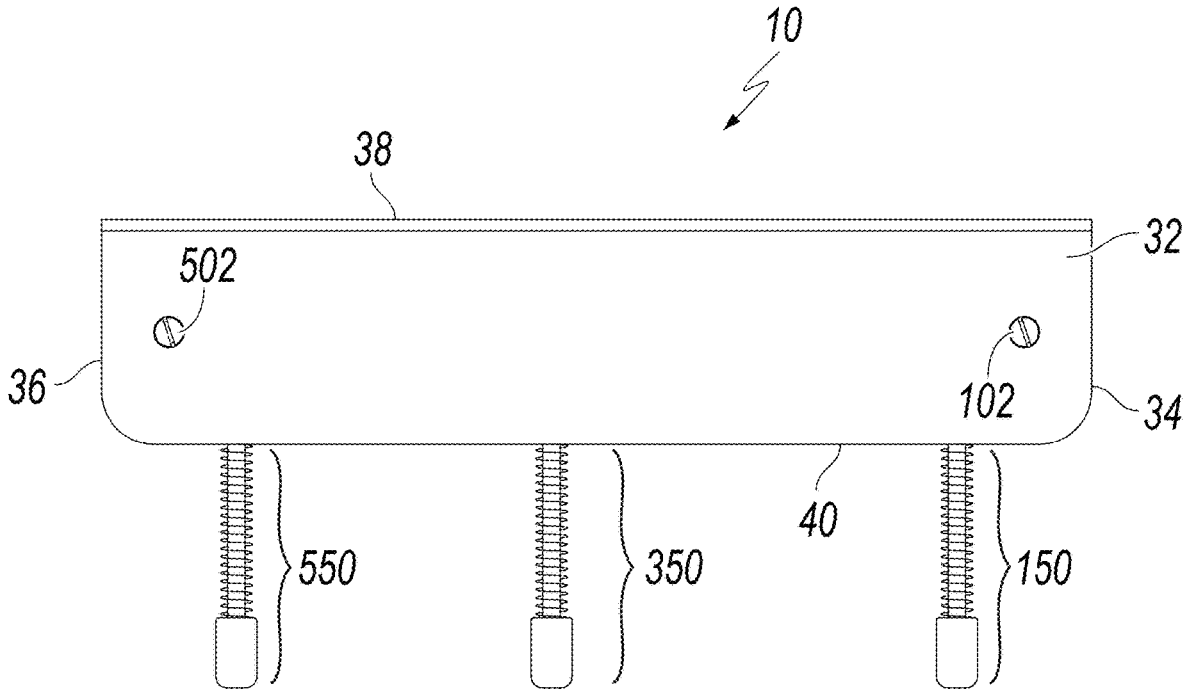
FIG. 3 illustrates a rear view of the exemplary PressPlay of FIG. 1.
Figure 4:
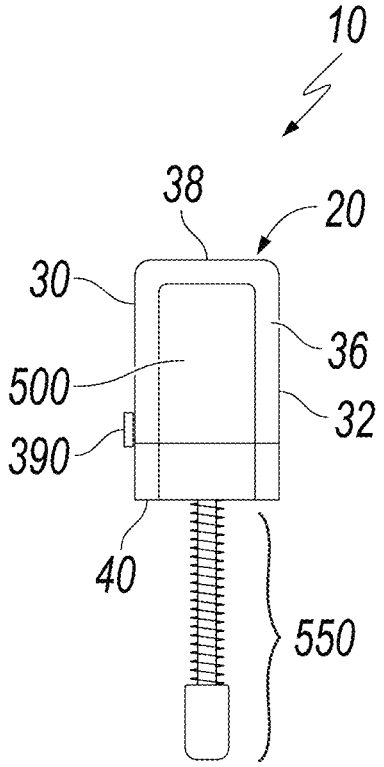
FIG. 4 illustrates a right side view of the exemplary PressPlay of FIG. 1.
Figure 5:
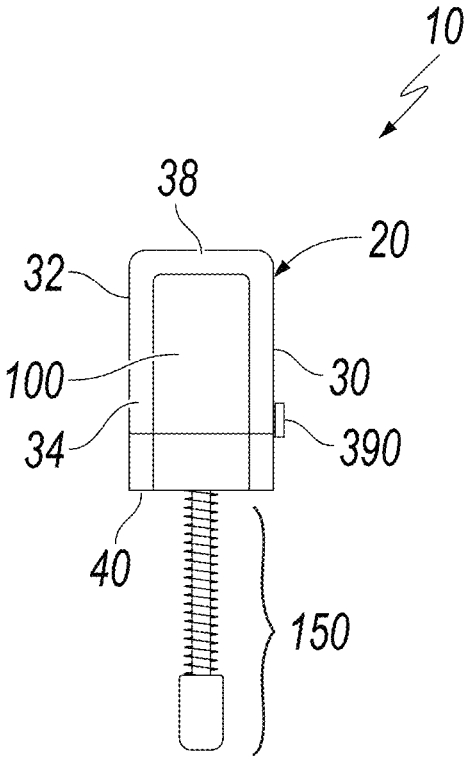
FIG. 5 illustrates a left side view of the exemplary PressPlay of FIG. 1.
Figure 6:
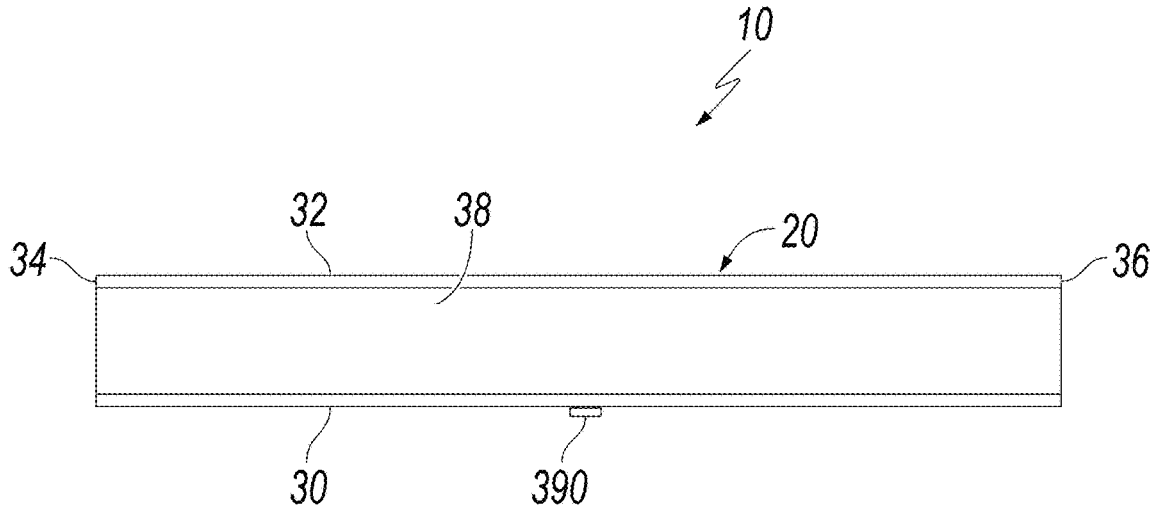
FIG. 6 illustrates a top view of the exemplary PressPlay of FIG. 1.
Figure 7:
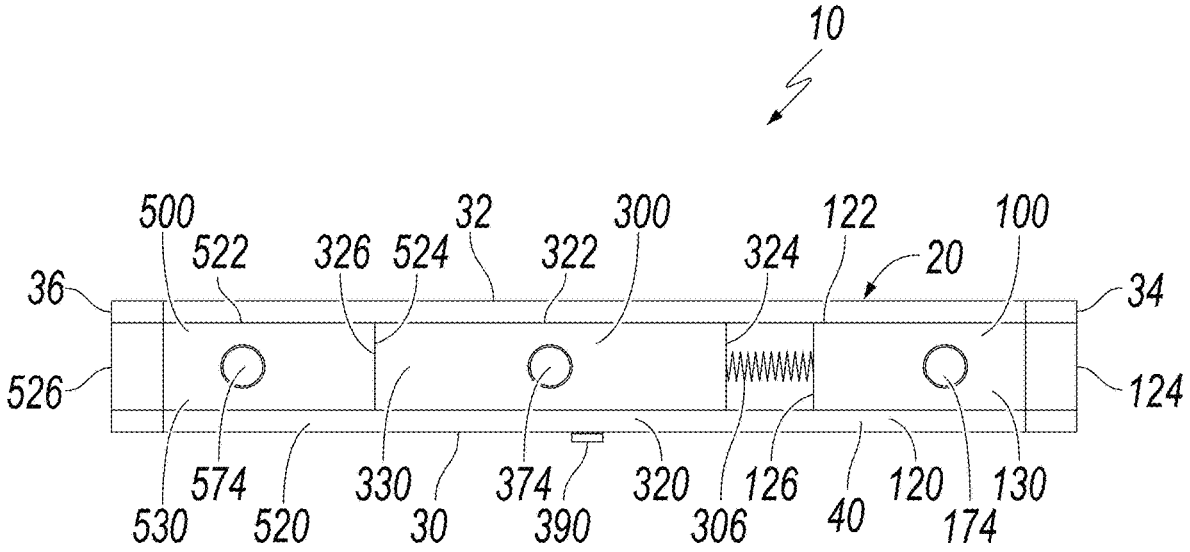
FIG. 7 illustrates a bottom view of the exemplary PressPlay of FIG. 1.
Figure 8:
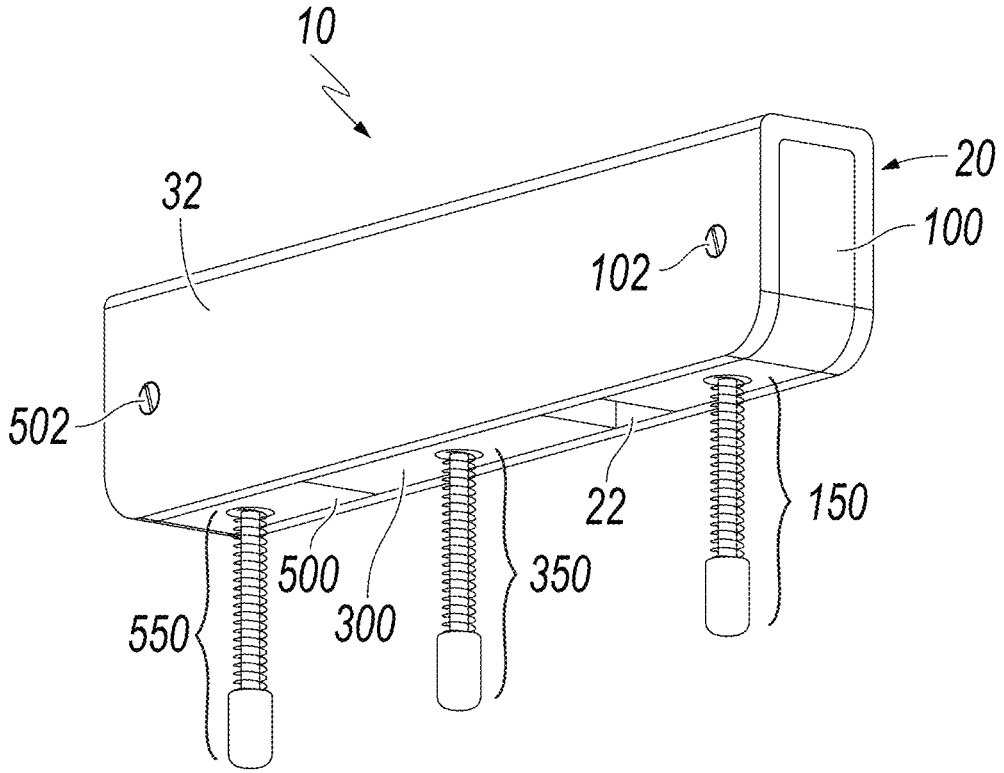
FIG. 8 illustrates a bottom-rear-left perspective view of the exemplary PressPlay of FIG. 1 with the middle pressing element away from the root pressing element for playing a major chord.
Figure 9:
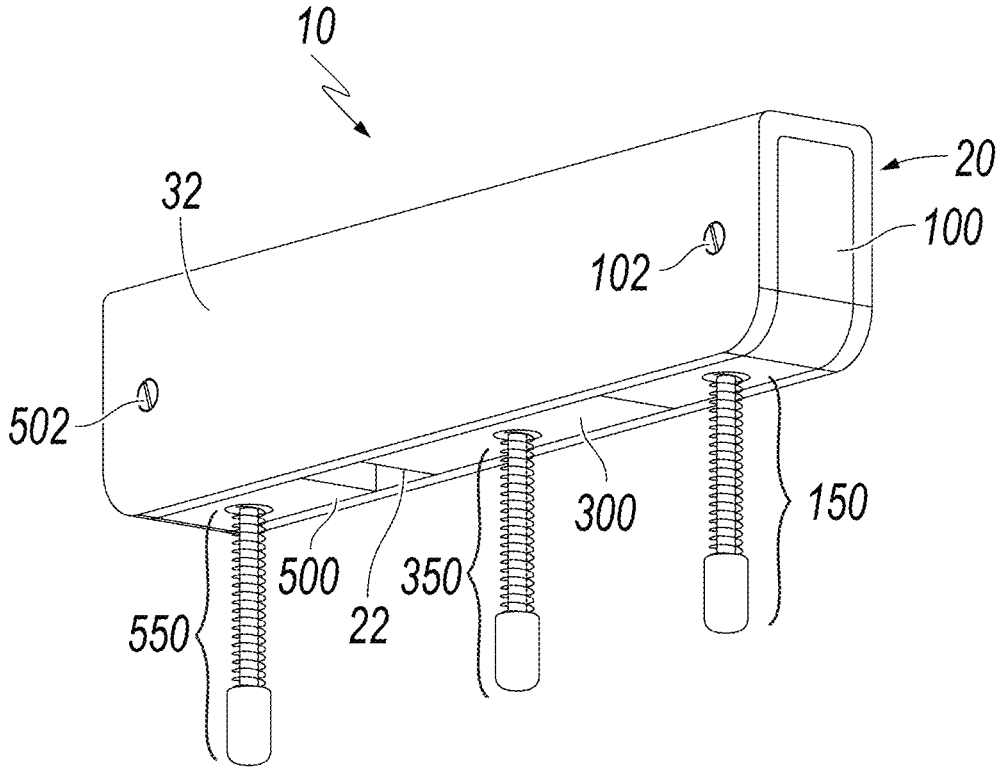
FIG. 9 illustrates a bottom-rear-left perspective view of the exemplary PressPlay of FIG. 1 with the middle pressing element closer to the root pressing element for playing a minor chord.
Figure 10:
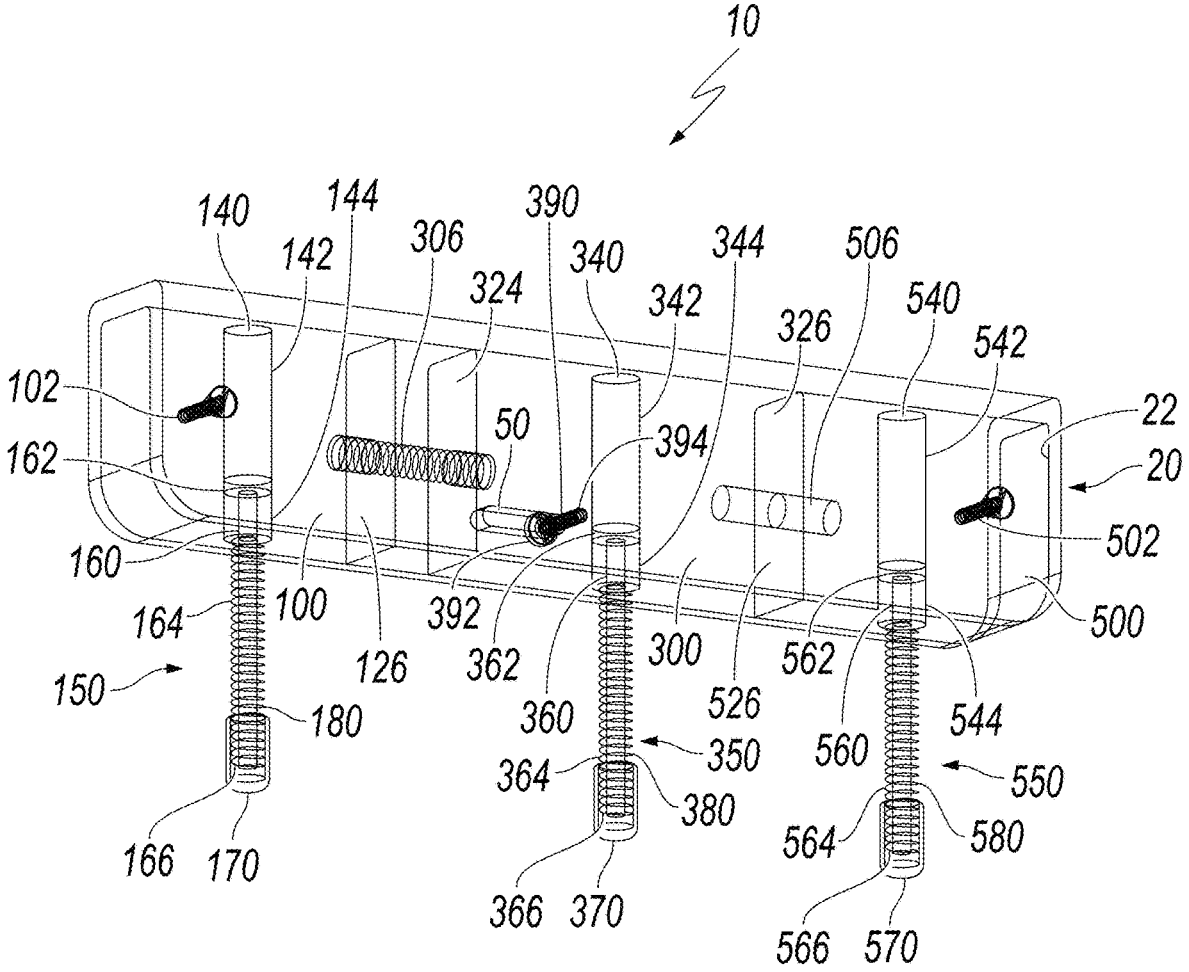
FIG. 10 illustrates a top-front-right transparent view of the exemplary PressPlay of FIG. 1.
Figure 11:
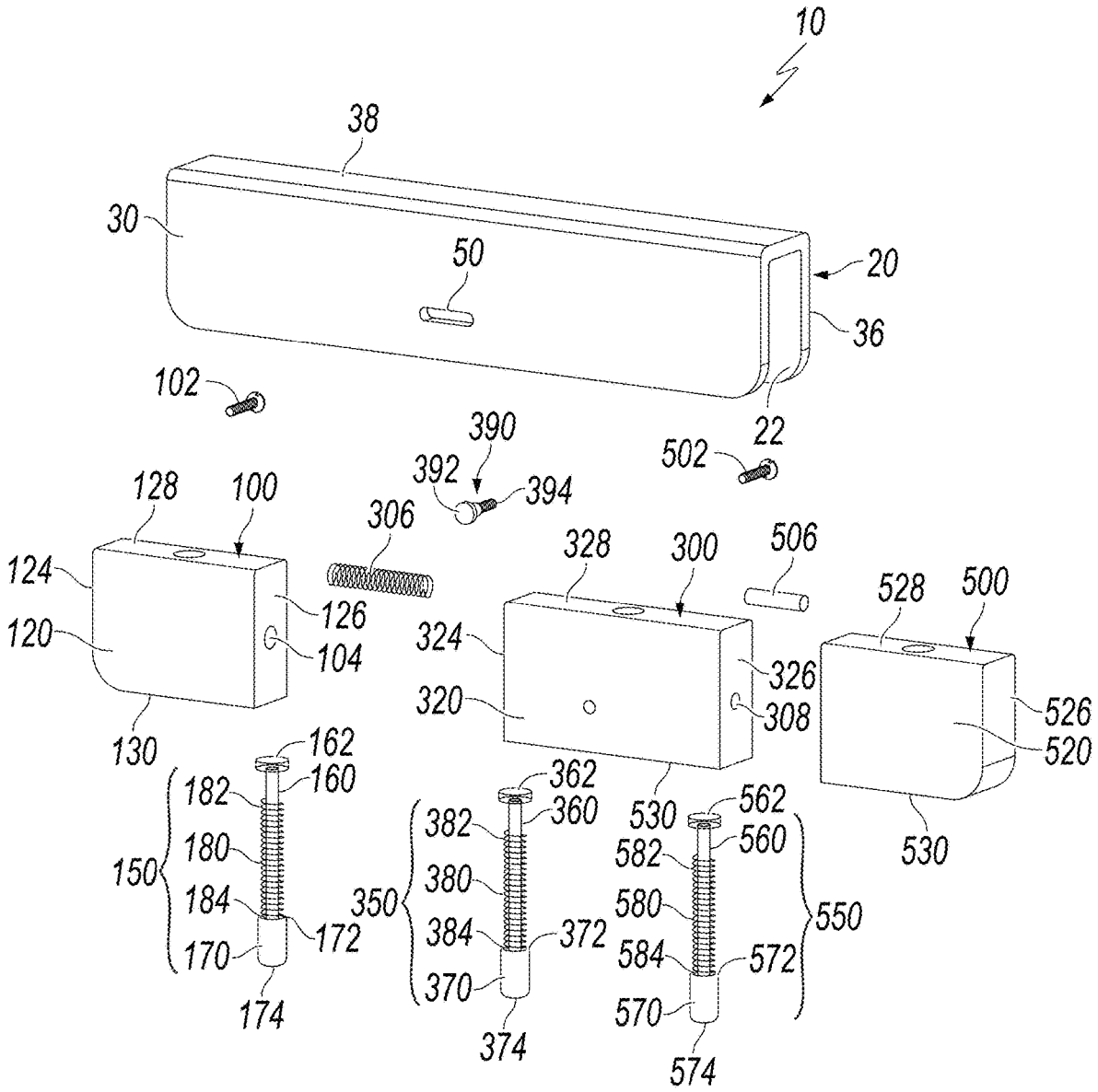
FIG. 11 illustrates an exploded view of the exemplary PressPlay of FIG. 1.

The figures illustrate an example embodiment of an adaptive equipment (also referred to as the "PressPlay") for playing chords on piano or keyboard. Reference now will be made in detail to embodiments of the disclosure, one or more examples of which are illustrated in the figures. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

FIGS. 1-11 illustrate a variety of views of an exemplary PressPlay 10 according to the present disclosure. The PressPlay 10 includes generally a shell 20 which may be defined by a front side 30, a rear side 32, a left side 34, a right side 36, a top side 38 and a bottom side 40. Particular embodiments of shell 20 may be a polyhedron of any three dimensional shape, including, but not limited to, a rectangular parallelepiped, a cube, a cylinder that is round or having a top and bottom of any other polygonal shape, a pyramid that is upright or inverted, whole or bisected, having a base comprising a rectangle or any other polygon, whole or bisected. In particular embodiments, shell 20 may be a box, crate, case, chest, or any other shape. In particular embodiments, each of the front, rear, left, right sides 30, 32, 34, 36 may be perpendicular to top side 38 and bottom side 40. Alternatively, each of the front, rear, left, right sides 30, 32, 34, 36 may be non-perpendicular, at an angle more or less than 90 degrees to top side 38 and bottom side 40.

In particular embodiments, top side 38 and bottom side 40 of shell 20 each is a rectangle with more than one or without round corners with a dimension of around 135 mm×20 mm, front side 30 and rear side 32 of shell 20 each is a rectangle with more than one or without round corners with a dimension of around 135 mm×35 mm, left side 34 and right side 36 of shell 20 each is a rectangle with more than one or without round corners with a dimension of around 20 mm×35 mm.

In particular embodiments, the front side 30, rear side 32 and top side 38 may be formed in a single, uniform piece. In particular embodiments, the front side 30, rear side 32 and top side 38 may be formed in an uniform n-shaped piece when viewing from left side 34 or right side 36. In particular embodiments, shell 20 has an interior cavity 22. Shell 20 may be made of any suitable material, including but not limited to acrylic, wood, carbon fiber, fiber glass, metal, plastic, and the like.

Referring to FIGS. 1-11, a root (or left) housing 100 is installed partially or fully within the interior cavity 22 of shell 20 and is positioned toward left side 34 of shell 20. In particular embodiments, root housing 100 is sized to fit within a portion of the interior cavity 22 of shell 20. In particular embodiments, root housing 100 is fixedly installed in shell 20. In particular embodiments, root housing 100 is installed in shell 20 with one or more screws 102. In other embodiments, root housing 100 is fixedly installed in shell 20 by glue or other means. In other embodiments, root housing 100 is uniformly formed with shell 20. Root housing 100 may be a polyhedron of any three dimensional shape, including, but not limited to, a rectangular parallelepiped, a cube, etc. In particular embodiments, root housing 100 has a front side 120, a rear side 122, a left side 124, a right side 126, a top side 128, and a bottom side 130. In particular embodiments, left side 124 of root housing 100 is flush with left side 34 of shell 20, and bottom side 130 of root housing 100 is flush with bottom side 40 of shell 20. Root housing 100 may be made of any suitable material, including but not limited to acrylic, wood, carbon fiber, fiber glass, metal, plastic, and the like.

A root housing channel 140 can be opened through bottom side 130 of root housing 100 with a longitudinal direction of root housing channel 140 being substantially perpendicular to bottom side 130 of root housing 100. In particular embodiments, root housing channel 140 has an upper channel 142 and a lower channel 144 in connection with upper channel 142. Upper channel 142 can be a right circular cylindrical opening with an upper channel diameter. Lower channel 144 can be a right circular cylindrical opening with a lower channel diameter that is smaller than upper channel diameter.

A root (or first or left) pressing element 150 configured to engage with a piano key can be provided. In some embodiments, the root pressing element 150 comprises a root pin 160, a root cap 170 and a root spring 180.

The root pin 160 can be provided with a portion of the pin 160 installed within root housing channel 140. In particular embodiments, root pin 160 has a head 162, a body 164 and a leg 166. Head 162 can be a circular cylinder with a diameter configured to be smaller than upper channel diameter of upper channel 142 and larger than lower channel diameter of lower channel 144 that head 162 can only slide or move within upper channel 142 but not within lower channel 144. Body 164 can be a circular cylinder with a diameter configured to be smaller than lower channel diameter of lower channel 144. In these configurations, when root pin 160 is partially installed in root housing channel 140, head 162 is allowed to move or slide within upper channel 142 while a portion of body 164 is allowed to move or slide within lower channel 144. In particular embodiments, root pin 160 is around 65 mm in length. Root pin 160 may be made of any suitable material, including but not limited to metal, plastic, wood, and the like. In particular embodiments, root pin 160 is made of a rigid material.

The root cap 170 can be sized to grasp leg 166. Cap 170 can has an upper ring 172 and a lower tip 174. Upper ring 172 has a diameter larger than the diameter of body 164. In particular embodiments, diameter of upper ring 172 is around 7 mm. Cap 170 may be made of any suitable material, including but not limited to rubber, latex, silicon, plastic, and the like.

The root spring 180 has an upper end 182 and a lower end 184. In particular embodiments, spring 180 is configured to circle around a portion of body 164 of pin 160. When pin 160 is partially installed within root housing channel 140, upper end 182 and lower end 184 of spring 180 can bias on bottom side 130 of root housing 100 and upper ring 172 of cap 170, respectively.

When no external force is applied to lower tip 174 of cap 170, a bias force from spring 180 can make body 164 extend to its maximum length to the outside of root housing 100 and that head 162 of root pin 160 is in its lowest position in upper channel 142. When an external force (e.g., a reaction force come from a piano keyboard) is applied to lower tip 174 of cap 170, root pin 160 can be pushed into root housing 100 until head 162 of root pin 160 reaches its highest position in upper channel 142.

Referring to FIGS. 1-11, a third (or middle) housing 300 is installed partially or fully within the interior cavity 22 of shell 20 and is positioned between root housing 100 and fifth housing 500. In particular embodiments, third housing 300 is sized to fit within a portion of the interior cavity 22 of shell 20. In particular embodiments, third housing 300 is movably installed in shell 20. In particular embodiments, third housing 300 is movable within shell 20 by a switch 390. Third housing 300 may be a polyhedron of any three dimensional shape, including, but not limited to, a rectangular parallelepiped, a cube, etc. In particular embodiments, third housing 300 has a front side 320, a rear side 322, a left side 324, a right side 326, a top side 328, and a bottom side 330. In particular embodiments, bottom side 330 of third housing 300 is flush with bottom side 40 of shell 20. Third housing 300 may be made of any suitable material, including but not limited to acrylic, wood, carbon fiber, fiber glass, metal, plastic, and the like.

A third housing channel 340 can be opened through bottom side 330 of third housing 300 with a longitudinal direction of third housing channel 340 being substantially perpendicular to bottom side 330 of third housing 300. In particular embodiments, third housing channel 340 has an upper channel 342 and a lower channel 344 in connection with upper channel 342. Upper channel 342 can be a right circular cylindrical opening with an upper channel diameter. Lower channel 344 can be a right circular cylindrical opening with a lower channel diameter that is smaller than upper channel diameter.

A third (or middle) pressing element 350 configured to engage with a piano key can be provided. In some embodiments, the third pressing element 350 comprises a third pin 360, a third cap 370 and a third spring 380.

The third pin 360 can be provided with a portion of pin 360 installed within the third housing channel 340. In particular embodiments, third pin 360 has a head 362, a body 364 and a leg 366. Head 362 can be a circular cylinder with a diameter configured to be smaller than upper channel diameter of upper channel 342 and larger than lower channel diameter of lower channel 344 that head 362 can only slide or move within upper channel 342 but not within lower channel 344. Body 364 can be a circular cylinder with a diameter configured to be smaller than lower channel diameter of lower channel 344. In these configurations, when third pin 360 is partially installed in third housing channel 340, head 362 is allowed to move or slide within upper channel 342 while a portion of body 364 is allowed to move or slide within lower channel 344. In particular embodiments, third pin 360 is around 65 mm in length. Third pin 360 may be made of any suitable material, including but not limited to metal, plastic, wood, and the like. In particular embodiments, third pin 360 is made of a rigid material.

The cap 370 sized to grasp leg 366 can be provided. Cap 370 can has an upper ring 372 and a lower tip 374. Upper ring 372 has a diameter larger than the diameter of body 364. In particular embodiments, diameter of upper ring 372 is around 7 mm. Cap 370 may be made of any suitable material, including but not limited to rubber, latex, silicon, plastic, and the like.

The spring 380 can have an upper end 382 and a lower end 384. In particular embodiments, spring 380 is configured to circle around a portion of body 364 of third pin 360. When third pin 360 is partially installed within third housing channel 340, upper end 382 and lower end 384 of spring 380 can bias on bottom side 330 of third housing 300 and upper ring 372 of cap 370, respectively.

When no external force is applied to lower tip 374 of cap 370, a bias force from spring 380 can make body 364 extend to its maximum length to the outside of third housing 300 and that head 362 of third pin 360 is in its lowest position in upper channel 342. When an external force (e.g., a reaction force come from a piano keyboard) is applied to lower tip 374 of cap 370, third pin 360 can be pushed into third housing 300 until head 362 of third pin 360 reaches its highest position in upper channel 342.

Third housing 300 can be configured to move between root housing 100 and fifth housing 500. One or more switches 390 can be fixedly or removably attached to third housing 300. Switch 390 can have an extension 392 extended over the front side 30 or rear side 32 or both sides 30, 32 of shell 20 to be accessible by a user. In particular embodiments, a slot or channel 50 can be opened on rear side 32 of shell 20 to allow a portion 394 of switch 390 to slide within the slot or channel 50 when the extension 392 of switch 390 is maneuvered by a user. In other embodiments, the slot or channel 50 can be opened on front side 30 of shell 20 to allow switch 390 accessible by a user. Yet in other embodiments, the slot or channel 50 can be opened on both front side 30 and rear side 32 of shell 20 to allow switch 390 accessible by a user from one or both sides 30, 32.

In particular embodiments, a spring 306 can be provided with one end of spring 306 fixedly or removably attached to right side 126 of root housing 100 and another end of spring 306 fixedly or removably attached to left side 324 of third housing 300. In particular embodiments, a hole or recess 104 is provided on the right side 126 of root housing 100 and another hole or recess 304 is provided on the left side 324 of third housing 300 to accept the ends of spring 306.

In particular embodiments, when no external force is applied to third housing 300, a bias force from spring 306 can push third housing 300 away from root housing 100 and toward fifth housing 500 until a set position. In particular embodiments, when no external force is applied to third housing 300, a bias force from spring 306 can push third housing 300 away from root housing 100 until right side 326 of third housing 300 touches left side 524 of fifth housing 500.

In particular embodiments, when an external force is applied to third housing 300 (e.g., a user pushes switch 390 toward the left direction), third housing 300 can be pushed toward root housing 100 until a set position. In particular embodiments, when an external force is applied to third housing 300, third housing 300 can be pushed toward root housing 100 until left side 324 of third housing 300 touches right side 126 of root housing 100.

In other embodiments, spring 306 can be provided between third housing 300 and fifth housing 500 that when no external force is applied to third housing 300, third housing 300 is away from fifth housing 500 while an external force can push third housing 300 toward root housing 100.

Referring to FIGS. 1-11, a fifth (or right) housing 500 is installed partially or fully within the interior cavity 22 of shell 20 and is positioned toward right side 36 of shell 20. In particular embodiments, fifth housing 500 is sized to fit within a portion of the interior cavity 22 of shell 20. In particular embodiments, fifth housing 500 is fixedly installed in shell 20. In particular embodiments, fifth housing 500 is installed in shell 20 with one or more screws 502. In other embodiments, fifth housing 500 is fixedly installed in shell 20 by glue or other means. In other embodiments, fifth housing 500 is uniformly formed with shell 20. Fifth housing 500 may be a polyhedron of any three dimensional shape, including, but not limited to, a rectangular parallelepiped, a cube, etc. In particular embodiments, fifth housing 500 has a front side 520, a rear side 522, a left side 524, a right side 526, a top side 528, and a bottom side 530. In particular embodiments, right side 526 of fifth housing 500 is flush with right side 36 of shell 20, and bottom side 530 of fifth housing 500 is flush with bottom side 40 of shell 20. Fifth housing 500 may be made of any suitable material, including but not limited to acrylic, wood, carbon fiber, fiber glass, metal, plastic, and the like.

A fifth housing channel 540 can be opened through bottom side 530 of fifth housing 500 with a longitudinal direction of fifth housing channel 540 being substantially perpendicular to bottom side 530 of fifth housing 500. In particular embodiments, fifth housing channel 540 has an upper channel 542 and a lower channel 544 in connection with upper channel 542. Upper channel 542 can be a right circular cylindrical opening with an upper channel diameter. Lower channel 544 can be a right circular cylindrical opening with a lower channel diameter that is smaller than upper channel diameter.

A fifth (or right) pressing element 550 configured to engage with a piano key can be provided. In some embodiments, the fifth pressing element 550 comprises a fifth pin 560, a fifth cap 570 and a fifth spring 580.

The fifth pin 560 can be provided with a portion of pin 560 installed within fifth housing channel 540. In particular embodiments, fifth pin 560 has a head 562, a body 564 and a leg 566. Head 562 can be a circular cylinder with a diameter configured to be smaller than upper channel diameter of upper channel 542 and larger than lower channel diameter of lower channel 544 that head 562 can only slide or move within upper channel 542 but not within lower channel 544. Body 564 can be a circular cylinder with a diameter configured to be smaller than lower channel diameter of lower channel 544. In these configurations, when fifth pin 560 is partially installed in fifth housing channel 540, head 562 is allowed to move or slide within upper channel 542 while a portion of body 564 is allowed to move or slide within lower channel 544. In particular embodiments, fifth pin 560 is around 65 mm in length. Fifth pin 560 may be made of any suitable material, including but not limited to metal, plastic, wood, and the like. In particular embodiments, fifth pin 560 is made of a rigid material.

The cap 570 sized to grasp leg 566 can be provided. Cap 570 can has an upper ring 572 and a lower tip 574. Upper ring 572 has a diameter larger than the diameter of body 564. In particular embodiments, diameter of upper ring 572 is around 7 mm. Cap 570 may be made of any suitable material, including but not limited to rubber, latex, silicon, plastic, and the like.

The spring 580 can have an upper end 582 and a lower end 584. In particular embodiments, spring 580 is configured to circle around a portion of body 564 of pin 560. When fifth pin 560 is partially installed within fifth housing channel 540, upper end 582 and lower end 584 of spring 580 can bias on bottom side 530 of fifth housing 500 and upper ring 572 of cap 570, respectively.

When no external force is applied to lower tip 574 of cap 570, a bias force from spring 180 can make body 564 extend to its maximum length to the outside of fifth housing 500 and that head 562 of fifth pin 560 is in its lowest position in upper channel 542. When an external force (e.g., a reaction force come from a piano keyboard) is applied to lower tip 574 of cap 570, fifth pin 560 can be pushed into fifth housing 500 until head 562 of pin 560 reaches its highest position in upper channel 542.

In particular embodiments, a stabilized mechanism or bar 506 can be provided with one end of bar 506 fixedly or slidably attached to right side 326 of third housing 300 and another end of bar 506 fixedly or slidably attached to left side 524 of fifth housing 500. In particular embodiments, a hole or recess 308 is provided on the right side 326 of third housing 300 and another hole or recess 508 is provided on the left side 524 of fifth housing 500 to accept the bar 506. In particular embodiments, when an external force is applied to third housing 300 that third housing 300 is pushed toward root housing 100, bar 506 can direct sliding direction of the third housing 300.

When a user applies the PressPlay 10 on piano keyboards, the piano keyboards "feel" soft touches from the spring biased caps 170, 270, 370 emulating human's hands and the piano keyboards react to the spring biased caps softly as oppose to situations where the piano keyboards are struck by rigid wood or metal sticks.

In some other embodiments, more than three housings can be provided. For example, a second root housing can be added to the right of fifth housing 500 with similar pin configurations as described in connection with the root, third, fifth housings 100, 300, 500. As another example, a second root housing and a second third housing can be added to the right side of fifth housing 500 with similar pin configurations as described in connection with the root, third, fifth housings 100, 300, 500. In some other embodiments, fifth housing 500 can move with third housing 300 within shell 20 that switch 390 can control both third housing 300 and fifth housing 500 at the same time.

Figure 12:
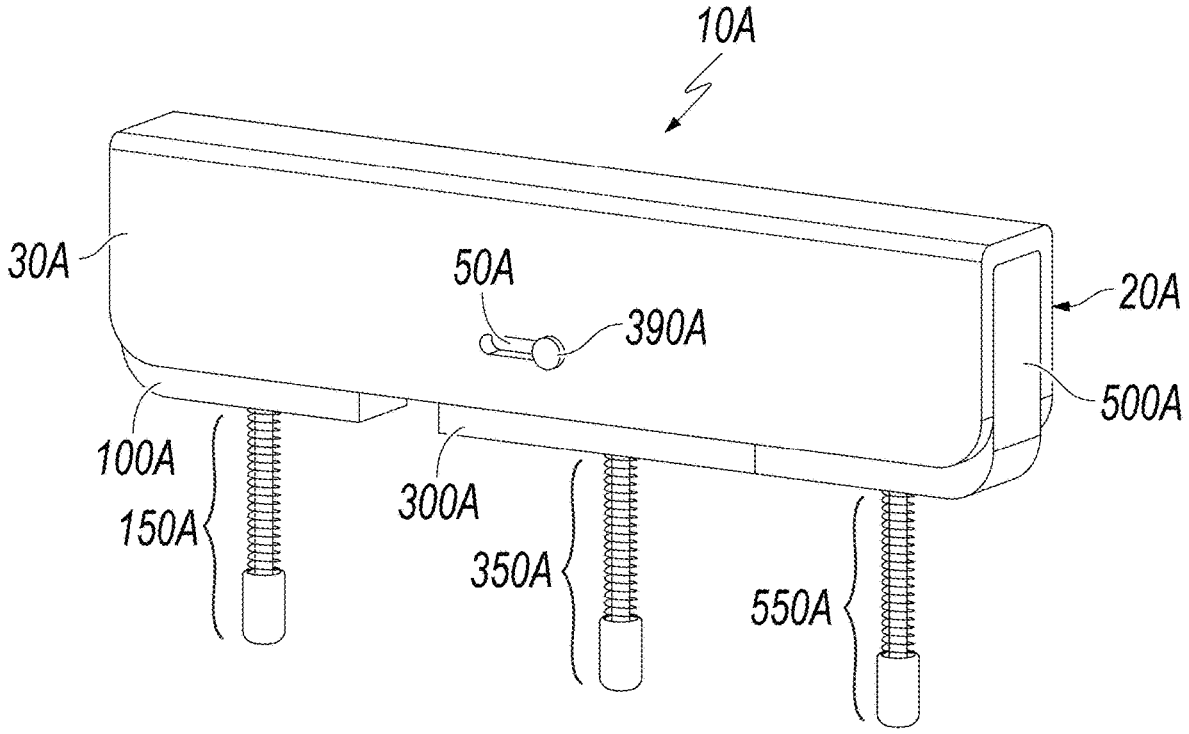
FIG. 12 illustrates a top-front-right perspective view of another exemplary PressPlay.
Figure 13:
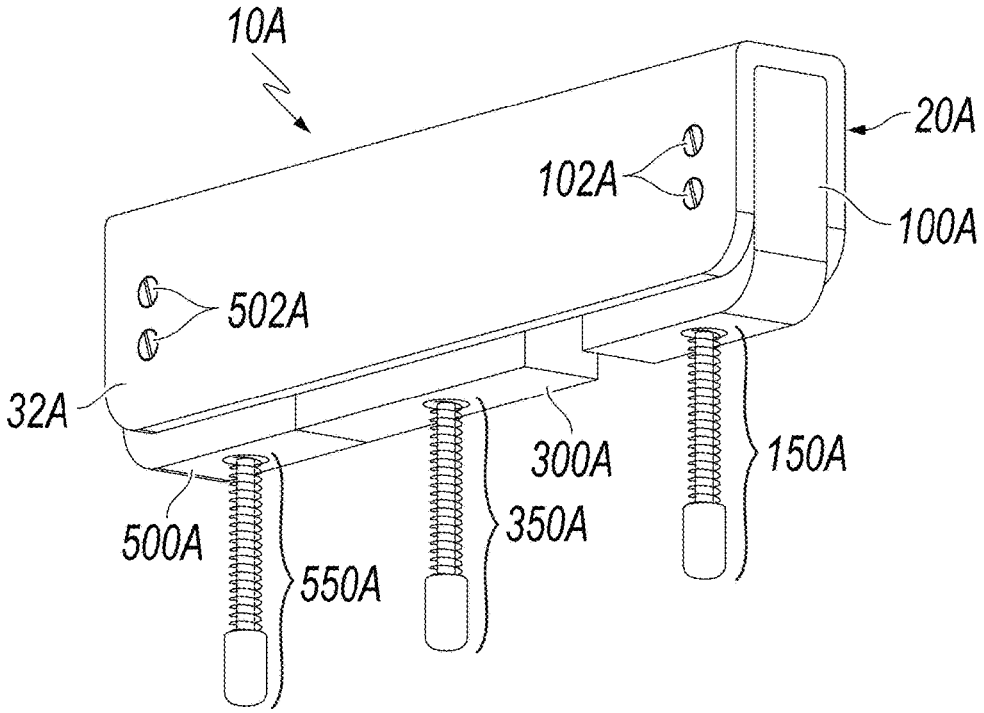
FIG. 13 illustrates a bottom-rear-left perspective view of the exemplary PressPlay of FIG. 12.

FIGS. 12-13 illustrate a variety of views of another exemplary PressPlay 10A according to the present disclosure. The PressPlay 10A is a variation of PressPlay 10 of FIGS. 1-11 that corresponding reference numbers used in describing features of PressPlay 10 can also be applied to features of PressPlay 10A. A significant difference between PressPlay 10A and PressPlay 10 is that bottom sides of root housing 100A, third housing 300A and fifth housing 500A are not flush with bottom side of shell 20A.

Figure 14:
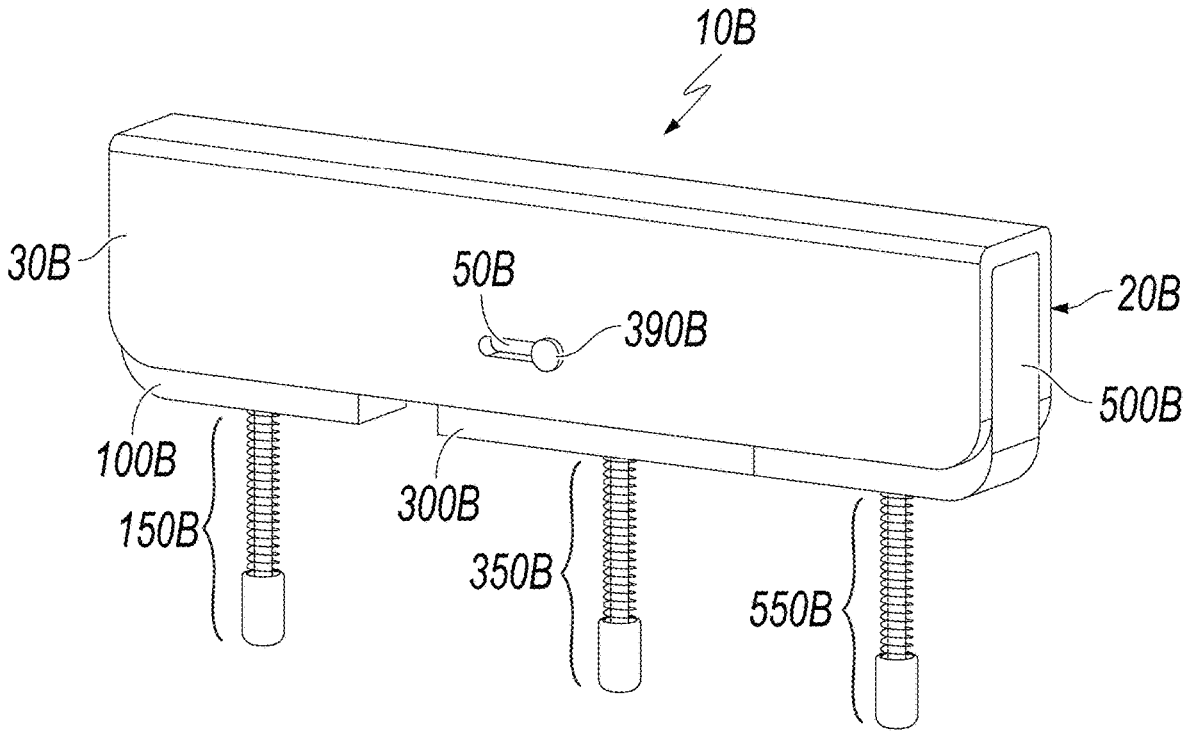
FIG. 14 illustrates a top-front-right perspective view of yet another exemplary PressPlay.
Figure 15:
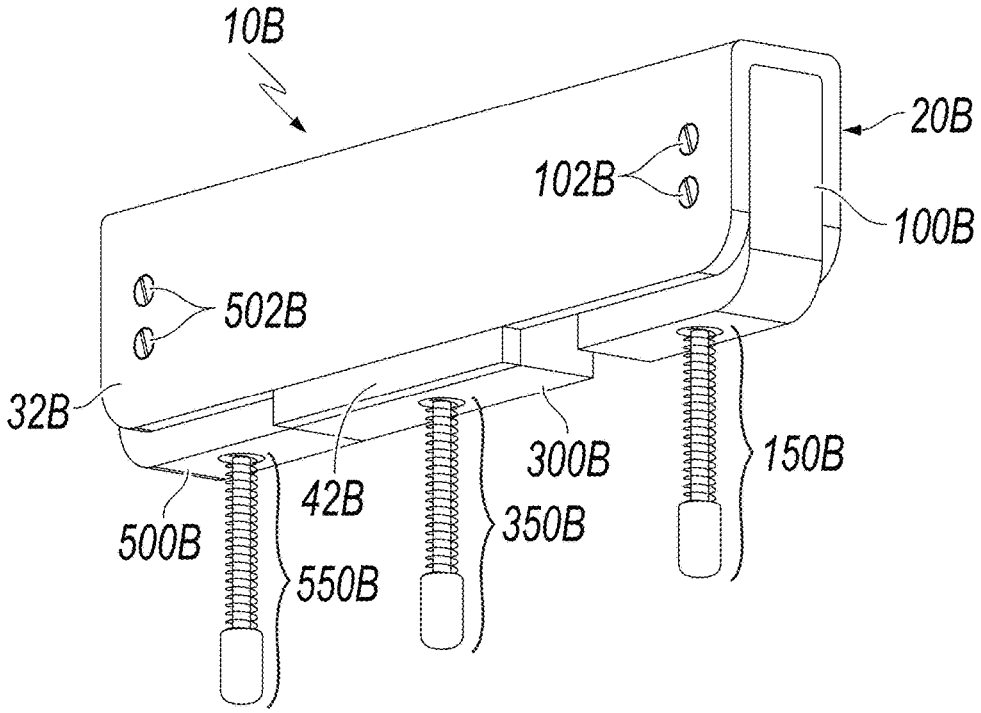
FIG. 15 illustrates a bottom-rear-left perspective view of the exemplary PressPlay of FIG. 14.

FIGS. 14-15 illustrate a variety of views of yet another exemplary PressPlay 10B according to the present disclosure. The PressPlay 10B is a variation of PressPlay 10 of FIGS. 1-11 that corresponding reference numbers used in describing features of PressPlay 10 can also be applied to features of PressPlay 10B. A significant difference between PressPlay 10B and PressPlay 10 is that bottom sides of root housing 100B, third housing 300B and fifth housing 500B are not flush with bottom side of shell 20B. An extension 42B can be provided to align with the rear side 32B of shell 20B that the bottom of the extension 42B is flush with bottom side of third housing 300B.

Figure 16:
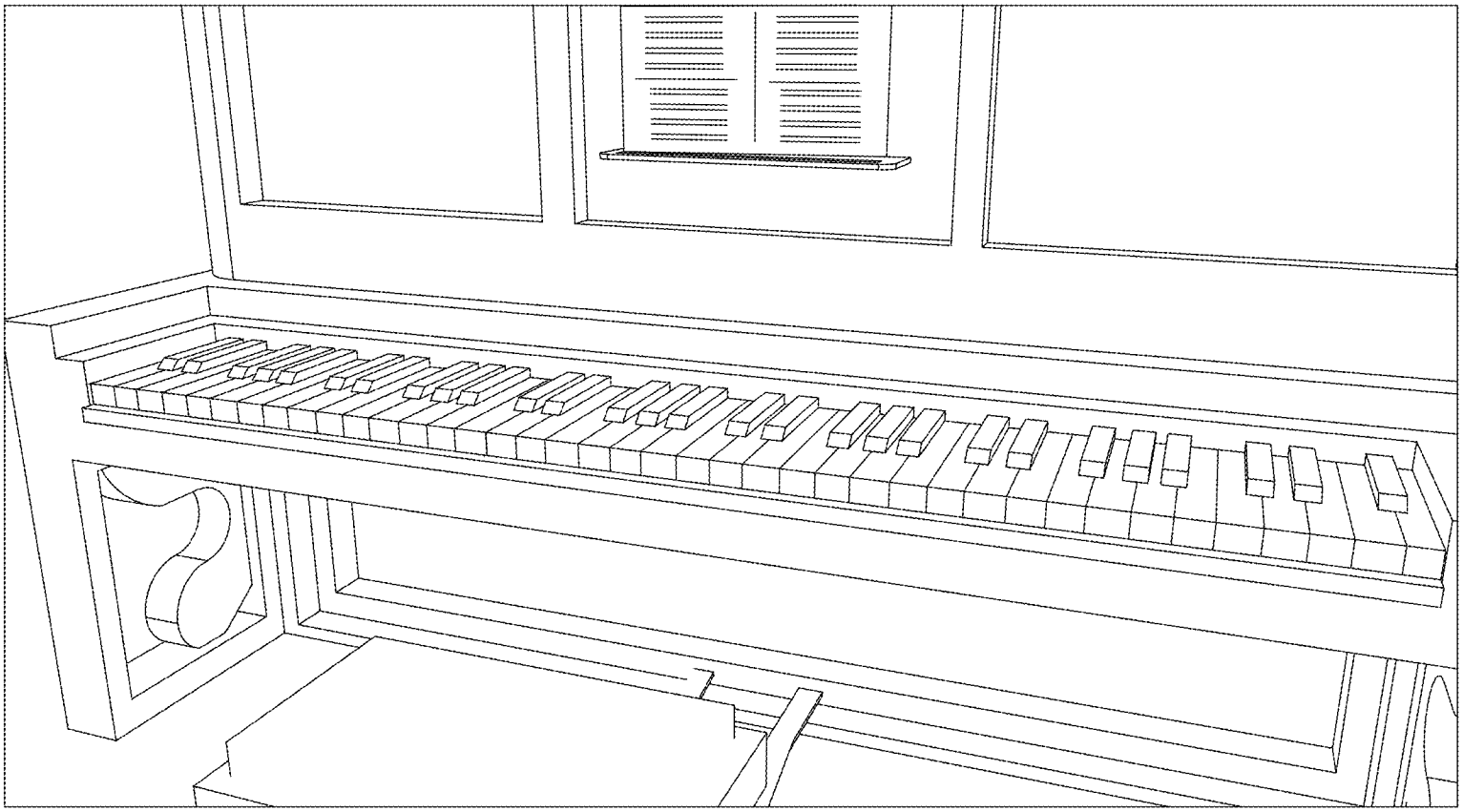
FIG. 16 illustrates a portion of an exemplary piano showing the piano keyboard.
Figure 17:
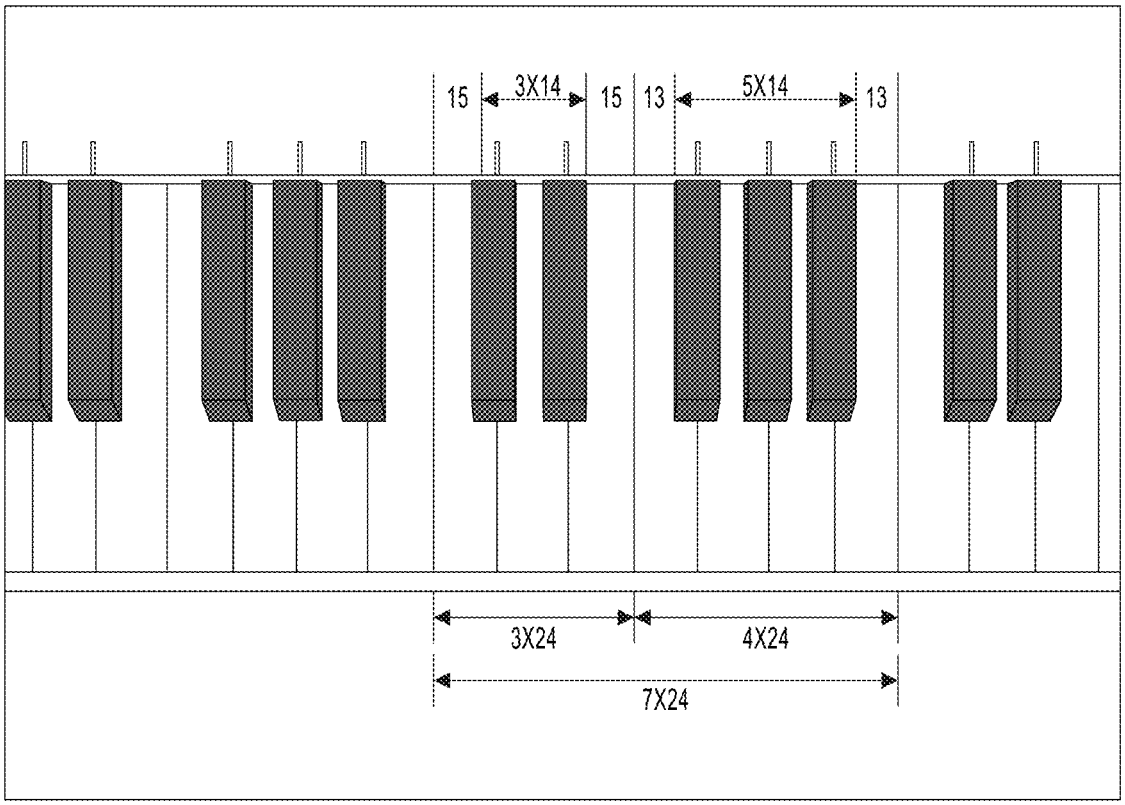
FIG. 17 illustrates a portion of the piano keyboard of FIG. 16 showing the dimensions of piano keys.

FIG. 16 illustrates a portion of an exemplary piano showing the piano keyboard. FIG. 17 illustrates a portion of the piano keyboard of FIG. 16 showing the dimensions of piano keys in one octal. As shown in the figure, the width of each of the white keys, i.e., keys for notes C, D, E, F, G, A, B, from left to right, is 24 millimeters (mm). The width of each of the black keys, i.e., notes D♭ (D-flat) or C♯ (C-sharp), E♭ or D♯, G♭ or F♯, A♭ or G♯, and Bb or A♯, from left to right, is 14 mm. The width of the narrower part of each of white keys for notes C and E is 15 mm. The width of the narrower part of each of white keys for notes D, G and A is 14 mm. The width of the narrower part of each of white keys for notes F and B is 13 mm. There is a small gap between any two adjacent keys. The measurements for each key include one half of the gap width on its left and one half of the gap width on its right.

The inventor of this application has created the PressPlay 10 by analyzing piano keyboard dimensions and calculating distances between root pressing element 150, third pressing element 350, and fifth pressing element 550 of the PressPlay 10 that the positions of root pressing element 150, third pressing element 350, and fifth pressing element 550 correspond to positions of any one of all major triads or any one of all minor triads on a piano keyboard depending on the position of the third pressing element 350.

Table 1 shows positions or locations of keys of a typical piano keyboard. Assuming that the key for middle C note has its left side aligned to the origin of an x-axis. The column labeled Left on top of Table 1 represents the position of the left side of the corresponding key, the column labeled Right on top of the table represents the position of the right side of the corresponding key, and the column labeled Center on top of the table represents the position of the center of the corresponding key. For example, the white key for the middle C note has its left side positioned at the origin of x-axis with a location at 0, its right side is located at 24 mm, and its center is positioned at location 12 mm. As another example, the white key for note D next to the middle C key has its left side positioned at location 24 mm, its right side positioned at location 48 mm, and its center positioned at location 36 mm.

TABLE 1

Piano Keyboard Positions (measured in millimeters)

| Key/Note | Left | Right | Center |
|---|---|---|---|
| C | 0 | 24 | 12 |
| D♭ / C♯ | 15 | 29 | 22 |
| D | 24 | 48 | 36 |
| E♭ / D♯ | 43 | 57 | 50 |
| E | 48 | 72 | 60 |
| F | 72 | 96 | 84 |
| G♭ / F♯ | 85 | 99 | 92 |
| G | 96 | 120 | 108 |
| A♭ / G♯ | 113 | 127 | 120 |
| A | 120 | 144 | 132 |
| B♭ / A♯ | 141 | 155 | 148 |
| B | 144 | 168 | 156 |
| C | 168 | 192 | 180 |
| D♭ / C♯ | 183 | 197 | 190 |
| D | 192 | 216 | 204 |
| E♭ / D♯ | 211 | 225 | 218 |
| E | 216 | 240 | 228 |
| F | 240 | 264 | 252 |
| G♭ / F♯ | 253 | 267 | 260 |

Table 2 illustrates results of calculation for distances between the root note and the third note (R-3), between the third note and the fifth note (3-5), and between the root note and the fifth note (R-5) for all major triads and minor triads. For example, when the root (R) position is at the middle C, for a major triad, the major third and perfect fifth are notes E and G, respectively. Accordingly, the distance between the root note C and the third note (R-3) for a major triad is the distance between the center location of key for note E (which is 60 mm) and the center location of key for note C (which is 12 mm), which is 48 mm (60 mm−12 mm=48 mm). The distance between the major third note and the perfect fifth note (3-5) for a major C triad is the distance between the center location of key for note G (which is 108 mm) and the center location of key for note E (which is 60 mm), which is 48 mm (108 mm−60 mm=48 mm). The distance between the root note C and the perfect fifth (R-5) for a major triad is the distance between the center location of key for note G (which is 108 mm) and the center location of key for note C (which is 12 mm), which is 96 mm (108 mm−12 mm=96 mm).

For a minor C triad, the minor third and perfect fifth are notes E♭ and G, respectively. Accordingly, the distance between the root note C and the third note (R-3) for a minor triad is the distance between the center location of key for note E♭ (which is 50 mm) and the center location of key for note C (which is 12 mm), which is 38 mm (50 mm−12 mm=38 mm). The distance between the minor third note and the perfect fifth note (3-5) for a minor C triad is the distance between the center location of key for note G (which is 108 mm) and the center location of key for note E♭ (which is 50 mm), which is 58 mm (108 mm−50 mm=58 mm). The distance between the root note C and the perfect fifth (R-5) for a minor triad is the distance between the center location of key for note G (which is 108 mm) and the center location of key for note C (which is 12 mm), which is 96 mm (108 mm−12 mm=96 mm). The rest of Table 2 can be obtained by similar calculations shown above.

TABLE 2

Distances Calculation (measured in millimeters)

| | Major Triad | | | Minor Triad | | |
|---|---|---|---|---|---|---|
| R Position | R—3 | 3—5 | R—5 | R—3 | 3—5 | R—5 |
| C | 48 | 48 | 96 | 38 | 58 | 96 |
| D♭/C# | 62 | 36 | 98 | 38 | 60 | 98 |
| D | 56 | 40 | 96 | 48 | 48 | 96 |
| E♭/D# | 58 | 40 | 98 | 42 | 56 | 98 |
| E | 60 | 36 | 96 | 48 | 48 | 96 |
| F | 48 | 48 | 96 | 36 | 60 | 96 |
| G♭/F# | 56 | 42 | 98 | 40 | 58 | 98 |
| G | 48 | 48 | 96 | 40 | 56 | 96 |
| A♭/G# | 60 | 38 | 98 | 36 | 62 | 98 |
| A | 58 | 38 | 96 | 48 | 48 | 96 |
| B♭/A# | 56 | 48 | 104 | 42 | 62 | 104 |
| B | 62 | 42 | 104 | 48 | 56 | 104 |

Table 3 illustrates the mean of distances between the root note and the third note (R-3), between the third note and the fifth note (3-5), between the root note and the fifth note (R-5) for all major triads and minor triads of Table 2. Table 3 also illustrates the deviation from each mean value to the smallest/largest value in its column in Table 2. For example, the mean value for R-3 major triad is 56 mm, the smallest value in the column is 48 mm when the root is C, F or G, the largest value in the column is 62 mm when the root is D♭/C♯ or B. Accordingly, the deviation is the larger of 8 mm (56 mm−48 mm=8 mm) and 6 mm (62 mm−56 mm=6 mm), which is 8 mm.

TABLE 3

Piano Keyboard Dimensions (measured in millimeters)

| | Major Triad | | | Minor Triad | | |
|---|---|---|---|---|---|---|
| | R—3 | 3—5 | R—5 | R—3 | 3—5 | R—5 |
| Mean | 56 | 42 | 98 | 42 | 56 | 98 |
| Deviation | 8 | 6 | 6 | 6 | 8 | 6 |

In particular embodiments, the mean values of Table 3 can be used to determine the distances between root pressing element 150, third pressing element 350, and fifth pressing element 550 of the PressPlay 10. In particular embodiments, the deviation values of Table 3 can be used to determine the tolerance for the distances between root pressing element 150, third pressing element 350, and fifth pressing element 550 of the PressPlay 10.

In particular embodiments, the distance between root pressing element 150 and fifth pressing element 550 of the PressPlay 10 is 98 mm. The distance between root pressing element 150 and third pressing element 350 of the PressPlay 10 is 56 mm when the PressPlay 10 is in the major position and the distance between root pressing element 150 and third pressing element 350 of the PressPlay 10 is 42 mm when the PressPlay 10 is in the minor position. The distance measurements can be measured from the center of each of the root pressing element 150, third pressing element 350 and fifth pressing element 550, respectively. Alternatively, the distance measurements can be measured from the left side of each of the root pressing element 150, third pressing element 350 and fifth pressing element 550, respectively. Alternatively, the distance measurements can be measured from the right side of each of the root pressing element 150, third pressing element 350 and fifth pressing element 550, respectively.

In some embodiments, the distance between root pressing element 150 and fifth pressing element 550 of the PressPlay 10 is 98 mm±1%. The distance between root pressing element 150 and third pressing element 350 of the PressPlay 10 is 56 mm 1% when the PressPlay 10 is in the major position and the distance between root pressing element 150 and third pressing element 350 of the PressPlay 10 is 42 mm±1% when the PressPlay 10 is in the minor position. In some embodiments, the distance between root pressing element 150 and fifth pressing element 550 of the PressPlay 10 is 98 mm±3%. The distance between root pressing element 150 and third pressing element 350 of the PressPlay 10 is 56 mm±3% when the PressPlay 10 is in the major position and the distance between root pressing element 150 and third pressing element 350 of the PressPlay 10 is 42 mm±3% when the PressPlay 10 is in the minor position. In some embodiments, the distance between root pressing element 150 and fifth pressing element 550 of the PressPlay 10 is 98 mm±5%. The distance between root pressing element 150 and third pressing element 350 of the PressPlay 10 is 56 mm±5% when the PressPlay 10 is in the major position and the distance between root pressing element 150 and third pressing element 350 of the PressPlay 10 is 42 mm±5% when the PressPlay 10 is in the minor position. In some embodiments, the distance between root pressing element 150 and fifth pressing element 550 of the PressPlay 10 is 98 mm±7%. The distance between root pressing element 150 and third pressing element 350 of the PressPlay 10 is 56 mm 7% when the PressPlay 10 is in the major position and the distance between root pressing element 150 and third pressing element 350 of the PressPlay 10 is 42 mm±7% when the PressPlay 10 is in the minor position.

Accordingly, an adaptive equipment, such as PressPlay 10, for playing all major triads and all minor triads on a piano keyboard is disclosed. A user of the PressPlay 10 can play all major triads and all minor triads on a piano when root pressing element 150, third pressing element 350, and fifth pressing element 550 touch on desired keys of a piano keyboard.

Figure 18:
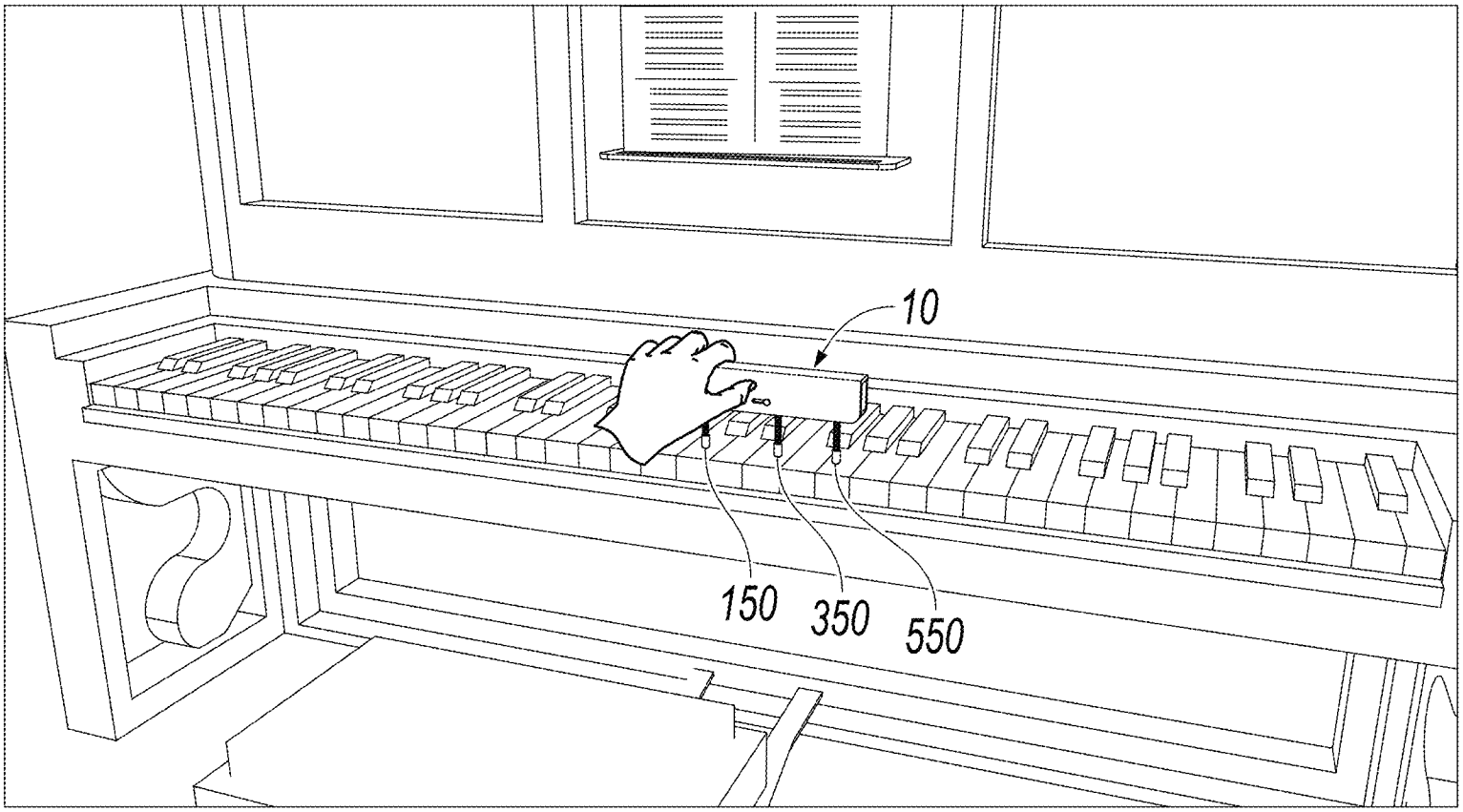
FIG. 18 illustrates the exemplary PressPlay of FIGS. 1-11 interacting with the exemplary piano keyboard of FIG. 16.

FIG. 18 illustrates an example of using the PressPlay 10. As illustrated in FIG. 18, the root pressing element 150, third pressing element 350, fifth pressing element 550 of the PressPlay 10 touches notes C-E-G of the piano keyboard, respectively, for playing a C major triad. Although not showing in the figures, the user can have the PressPlay 10 touch notes D♭-F-A♭ of the piano keyboard for playing a D♭ major triad, to have the PressPlay 10 touch notes D-F♯-A of the piano keyboard for playing a D major triad, and so on. As illustrated in FIG. 18, the PressPlay 10 touches notes C-E-G of the lower part (i.e., the front area where only white keys extend) of the piano keyboard for playing a C major triad which involved only white keys. Because the black keys sit higher than and to the rear of the white keys, when at least one black key is formed in a triad, for example, D♭-F-A♭ and D-F♯-A, the user can move the PressPlay 10 over the upper part (i.e., where the black keys are placed) of the keyboard that black key(s) and white key(s) in a triad are touched simultaneously.

When playing a minor triad is desired, the user can push and hold the switch to the left so that the third pressing element 350 is positioned toward the root pressing element 150. For example, the user can have the PressPlay 10 touch notes C-E♭-G of the piano keyboard for playing a C minor triad, to have the PressPlay 10 touch notes of the piano keyboard for playing a C♯ minor triad, and so on.

Accordingly, the user can play all major triads and all minor triads on a piano when root pressing element 150, third pressing element 350, and fifth pressing element 550 touch on desired keys of a piano keyboard. The PressPlay 10 is thus an adaptive equipment for a user to play any one of all major triads or minor triads on a piano keyboard or other keyboards to provide enhanced learning and playing experiences to the user.

In particular embodiments, a fourth housing and a fifth housing can be added to the right side of fifth housing 500 with similar pressing element configurations as described in connection with the root, third, fifth housings 100, 300, 500. The fourth housing and fifth housing correspond to a second root housing and a second third housing that the PressPlay have five pressing elements, e.g., first root pressing element 150, first third pressing element 350, fifth pressing element 550, second root pressing element (not shown), second third pressing element (not shown), corresponding to touching root, third, fifth, second root and second third pressing elements simultaneously so that the adaptive equipment allows a user to experience root position chords as well as the first and second inversions of all major and minor chords.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

This disclosure encompasses all changes, substitutions, variations, alterations, and modifications to the exemplary embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

The invention claimed is:

1. An adaptive equipment for playing chords on a keyboard of a musical instrument, the adaptive equipment comprising:

a shell defined by a front side, a rear side, a left side, a right side, a top side and a bottom side, the shell having an interior cavity;

a root pressing element partially installed within a root housing channel of a root housing, the root housing is fixedly installed within the interior cavity of the shell and is positioned toward the left side of the shell;

a fifth pressing element partially installed within a fifth housing channel of a fifth housing, the fifth housing is fixedly installed within the interior cavity of the shell and is positioned toward the right side of the shell; and a third pressing element partially installed within a third housing channel of a third housing, the third housing is movably installed within the interior cavity of the shell and is positioned between the root housing and the fifth housing, wherein the root pressing element, the third pressing element and the fifth pressing element correspond to a major triad on a piano keyboard when the third housing is positioned toward the fifth housing, and wherein the root pressing element, the third pressing element and the fifth pressing element correspond to a minor triad on the piano keyboard when the third housing is positioned toward the root housing.

2. The adaptive equipment of claim 1, wherein the front side, rear side and top side of the shell form an uniform n-shaped piece when viewing from the left side or the right side of the shell.

3. The adaptive equipment of claim 1 further comprises a switch attached to the third housing.

4. The adaptive equipment of claim 3 further comprises a slot opened on the shell and configured to allow a portion of the switch to slide within the slot when an extension of the switch is maneuvered by a user to switch the third housing between the root housing and the fifth housing.

5. The adaptive equipment of claim 4, wherein the slot is opened on the rear side of the shell.

6. The adaptive equipment of claim 3 further comprises a switching spring with one end of the switching spring attached to a right side of the root housing and another end of the switching spring attached to a left side of the third housing.

7. The adaptive equipment of claim 3 further comprises a stabilized mechanism with one end of the stabilized mechanism fixedly or slidably attached to the right side of the third housing and another end of the stabilized mechanism fixedly or slidably attached to the left side of the fifth housing.

8. The adaptive equipment of claim 1, wherein the root housing channel has an upper channel having an upper channel diameter and a lower channel in connection with upper channel, and wherein the lower channel has a lower channel diameter that is smaller than upper channel diameter.

9. The adaptive equipment of claim 8, wherein the root pressing element further comprises a root pin having a head, a body and a leg, and wherein the head is slidable within the upper channel while a portion of the body is slidable within the lower channel.

10. The adaptive equipment of claim 9, wherein the root pressing element further comprises a root cap sized to grasp the leg and having an upper ring and a lower tip, wherein the upper ring has an upper ring diameter that is larger than a diameter of the body.

11. The adaptive equipment of claim 10, wherein the root pressing element further comprises a root spring having an upper end and a lower end, wherein the root spring circle around a portion of the body of the root pin with the upper end and the lower end of the spring bias on the bottom side of the root housing and the upper ring of the cap, respectively.

12. An adaptive equipment for playing chords on a keyboard of a musical instrument, the adaptive equipment comprising:

a shell;

a root pressing element, at least a portion of the root pressing element is slidably coupled within the shell and is positioned toward a first side of the shell;

a fifth pressing element, at least a portion of the fifth pressing element is slidably coupled within the shell and is positioned toward a second side opposing to the first side of the shell; and a third pressing element, at least a portion of the third pressing element is slidably and movably coupled within the shell and is positioned between the root pressing element and the fifth pressing element, wherein the root pressing element, the third pressing element and the fifth pressing element correspond to a major triad on a piano keyboard when the third pressing element is positioned toward the fifth pressing element, and wherein the root pressing element, the third pressing element and the fifth pressing element correspond to a minor triad on the piano keyboard when the third pressing element is positioned toward the root pressing element.

13. The adaptive equipment of claim 12 further comprises a switch coupled to the third pressing element.

14. The adaptive equipment of claim 13 further comprises a slot opened on the shell and configured to allow a portion of the switch to slide within the slot when an extension of the switch is maneuvered by a user to move the third pressing element between the root pressing element and the fifth pressing element.

15. The adaptive equipment of claim 14, wherein the slot is opened on a rear side of the shell.

16. An adaptive equipment for playing chords on a keyboard of a musical instrument, the adaptive equipment comprising:

a shell having a root channel, a fifth channel and a third channel, the root channel has an upper root channel and a lower root channel in connection with upper root channel, the upper root channel has an upper root channel diameter and the lower root channel has a lower root channel diameter that is smaller than upper root channel diameter, the fifth channel has an upper fifth channel and a lower fifth channel in connection with upper fifth channel, the upper fifth channel has an upper fifth channel diameter and the lower fifth channel has a lower fifth channel diameter that is smaller than upper fifth channel diameter, the third channel has an upper third channel and a lower third channel in connection with upper third channel, the upper third channel has an upper third channel diameter and the lower third channel has a lower third channel diameter that is smaller than upper third channel diameter;

a root pin slidably attached to the shell and is positioned toward a first side of the shell, the root pin has a root head, a root body and a root leg, the root head is slidable within the upper root channel while a portion of the root body is slidable within the lower root channel;

a fifth pin slidably attached to the shell and is positioned toward a second side of the shell, the fifth pin has a fifth head, a fifth body and a fifth leg, the fifth head is slidable within the upper fifth channel while a portion of the fifth body is slidable within the lower fifth channel; and a third pin slidably attached to the shell and is positioned between the root pin and the fifth pin, the third pin has a third head, a third body and a third leg, the third head is slidable within the upper third channel while a portion of the third body is slidable within the lower third channel, wherein the root pin, the third pin and the fifth pin correspond to a major triad on a piano keyboard.

17. The adaptive equipment of claim 16 further comprises a root cap sized to grasp the leg and having an upper ring and a lower tip, wherein the upper ring has an upper ring diameter that is larger than a diameter of the body.

18. The adaptive equipment of claim 17 further comprises a root spring having an upper end and a lower end, wherein the root spring circle around a portion of the body of the root pin with the upper end and the lower end of the spring bias on a bottom side of the shell and the upper ring of the cap, respectively.

19. The adaptive equipment of claim 16 further comprises a switch coupled to the third pin.

20. The adaptive equipment of claim 19 further comprises a slot opened on the shell and configured to allow a portion of the switch to slide within the slot when an extension of the switch is maneuvered by a user to move the third pin between the root pin and the fifth pin.

* * * * *